US006237463B1

(12) United States Patent
Grizzaffi

(10) Patent No.: US 6,237,463 B1
(45) Date of Patent: May 29, 2001

(54) ISOLATION SYSTEM MOUNT FOR MOUNTING SENSITIVE ELECTRONIC EQUIPMENT TO NON-RECOILED ARTILLERY

(75) Inventor: Lauralee Grizzaffi, Lutz, FL (US)

(73) Assignee: Honeywell Inc., Morristown, NJ (US)

( * ) Notice: Subject to any disclaimer, the term of this patent is extended or adjusted under 35 U.S.C. 154(b) by 0 days.

(21) Appl. No.: 09/332,454

(22) Filed: Jun. 14, 1999

(51) Int. Cl.[7] ..... F41A 25/26

(52) U.S. Cl. ..... 89/41.17; 89/44.02; 89/37.01; 89/40.01

(58) Field of Search ..... 89/41.17, 41.09, 89/44.02, 37.01, 40.01; 42/103

(56) References Cited

U.S. PATENT DOCUMENTS

| | | | | |
|---|---|---|---|---|
| 3,483,623 | | 12/1969 | Kruzell . | |
| 4,026,054 | | 5/1977 | Snyder . | |
| 4,524,675 | * | 6/1985 | Durenec et al . | 89/41.03 |
| 4,691,616 | * | 9/1987 | Larsson et al. | 89/41.07 |
| 4,936,190 | * | 6/1990 | Pilcher, II | 89/41.17 |
| 4,972,619 | * | 11/1990 | Eckert | 42/94 |
| 5,189,245 | * | 2/1993 | Bundy | 89/14.1 |

FOREIGN PATENT DOCUMENTS

| | | | | |
|---|---|---|---|---|
| 36 41 006 | | 6/1988 | (DE) . | |
| 403103 | * | 12/1930 | (EP) | 89/41.17 |
| 0 403 103 | | 12/1990 | (EP) . | |
| 0 601 824 | | 6/1994 | (EP) . | |

* cited by examiner

*Primary Examiner*—Stephen M. Johnson
(74) *Attorney, Agent, or Firm*—Kris T. Fredrick

(57) ABSTRACT

An isolation system mount for mounting an electronic navigation system to the barrel of a non-recoiled artillery. The mount includes a navigation system cradle supported from an artillery barrel mount by first and second sets of elastomer isolators. The mount provides a high degree of three-dimensional shock and thermal isolation.

29 Claims, 5 Drawing Sheets

ISOLATION SYSTEM MOUNT FOR MOUNTING SENSITIVE ELECTRONIC EQUIPMENT TO NON-RECOILED ARTILLERY

The Government has rights in this invention pursuant to Contract No. DAAE30-97C-1087 awarded by the Department of the Army.

BACKGROUND OF THE INVENTION

1. Field of the Invention

The present invention relates generally to electronic system mounting units. In particular, the present invention is an isolation system mount for mounting shock and temperature—sensitive electronic equipment to the barrel of non-recoiled artillery.

2. Description of the Related Art

Recoiled artillery, artillery that includes a mechanism which absorbs shock experienced during gun firing, is pointed or aimed through the use of electronic navigation systems mounted to the gun tube or barrel. Electronic navigation systems of these types are sensitive to the heat and shock which can be generated during gun firing. By way of example, the electronic navigation systems can have reliability junction temperature and terminal junction failure limits in the range of 200–300° F., and a shock reliability limit on the order of 20 Gs at frequencies through 50 Hz. However, these reliability and terminal failure level limits are generally sufficiently high enough to withstand the operating environment of recoiled artillery, even during rapid firing sequences.

The temperature and shock environment of non-recoiled artillery is much more extreme than that of recoiled artillery since the shock absorbing mechanism no longer exists. By way of example, the barrel of a 120 mm mortar can reach temperatures of 600° F. during rapid firing sequences and shock levels of 40 Gs to 70 Gs at 20 Hz. Electronic navigation systems would generally be incapable of precise and repeatable pointing operation under these conditions if they were mounted directly to the barrel.

The use of a shock-absorbing mount for securing an electronic navigation system to non-recoiled artillery has been suggested. The mount includes a navigation system base plate supported between a pair of clamp plates mounted to and extending perpendicularly from the artillery barrel at spaced-apart positions. The base plate is slidably suspended from the barrel clamp plates on metal rods, thereby enabling the base plate and navigation system mounted thereon to slide on the rods between the barrel clamp plates in a direction parallel to the longitudinal barrel axis. Springs around each rod and between the edge of the base plate and the barrel clamp plates absorb some of the shock to which the navigation system would otherwise be subjected. This approach, however, would provide only limited shock and temperature isolation.

It is evident that there is a need for improved systems for mounting sensitive electronic equipment to artillery. In particular, there is a need for mounting systems which will enable currently available navigation systems to be used on non-recoiled artillery. Any such mounting system must be reliable and capable of providing a high degree of temperature and shock isolation, even during rapid fire environments. The mounting system must also be efficient to manufacture.

SUMMARY OF THE INVENTION

The present invention is an isolation system mount for mounting sensitive electronic equipment such as a pointing system to the barrel of a non-recoiled artillery. One embodiment to the invention includes an artillery mount adapted to be mounted to the artillery, and an electronic equipment cradle adapted to have the electronic equipment mounted thereto. The equipment cradle is elastomerically supported from the artillery mount by one or more elastomer isolators. Each elastomer isolator has a first portion attached to the artillery mount and a second portion attached to the electronic equipment cradle. The isolation mount is capable of providing a sufficiently high degree of three-dimensional shock and thermal isolation that currently available navigation systems can be operated within their temperature and shock reliability and terminal failure limits, even during rapid fire sequences.

Another embodiment of the invention includes an artillery barrel mount and an equipment cradle. Both the barrel mount and the equipment cradle have first and second spaced-apart plates. The barrel mount is adapted to be mounted to an artillery barrel with its first and second plates spaced about an axis which is parallel to a longitudinal barrel axis. The equipment cradle is mounted to the barrel mount by first and second sets of elastomer isolators, and has its first and second plates spaced about an axis which is parallel to the longitudinal barrel axis. Each isolator of the first set has a first end attached to the first plate of the artillery barrel mount and a second end attached to the first plate of the electronic equipment cradle. Similarly, each isolator of the second set has a first end attached to the second plate of the artillery barrel mount and a second end attached to the second plate of the electronic equipment cradle. The isolators elastomerically support the equipment cradle from the artillery barrel mount to provide three-dimensional shock and thermal isolation.

DETAILED DESCRIPTION OF THE PREFERRED EMBODIMENTS

Figure 1:
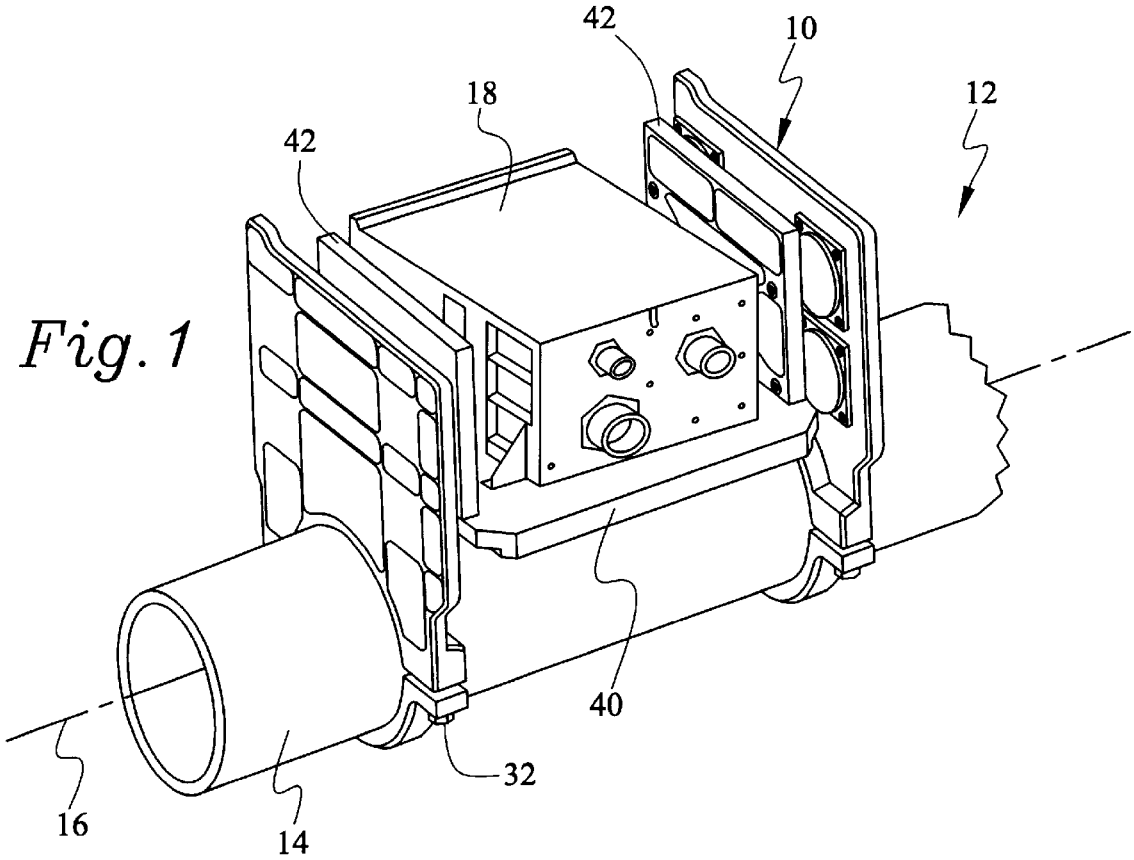
FIG. 1 is an isometric view of a mortar having a navigation system mounted to its barrel by an isolation mount system in accordance with the present invention.

A mortar 12 (i.e., a non-recoiled artillery) including an isolation mount system 10 in accordance with the present invention is illustrated generally in FIG. 1. As shown, mortar 12 includes a gun tube or barrel 14 having a longitudinal axis 16. Navigation system 18, an electronic system used to point or aim the mortar 12, is mounted to the barrel 14 by isolation mount system 10. During use, and especially during rapid firing sequences, mortar 12 generates considerable amounts of heat and shock. Isolation mount system 10 isolates and effectively protects the navigation system 18 from this high temperature and shock environment, thereby enabling accurate and repeatable aiming.

Isolation system mount 10 can be described in greater detail with reference to FIGS. 2–4. As shown, the mount 10 includes a pair of clamp plates 22 which are mounted to the barrel 14 by associated clamps 24, and a navigation system cradle 20. The cradle 20 is mounted to and suspended from the clamp plates by elastomer isolators 27.

Clamp plates 22 and clamps 24 function as a mortar mount to interface elastomer isolators 27 to barrel 14, and can be described with reference to FIGS. 2–6. Each clamp plate 22 has a cradle supporting section 26 and a barrel mounting section 28. The barrel mounting section 28 has a semicircular opening 30 which is sized to engage the outer surface of the mortar barrel 14. Clamps 24 are semicircular in shape, and engage the outer surface of the mortar barrel 14 on the side opposite the openings 30 in the clamp plates 22. Fasteners such as bolts 32 secure the sides of clamps 24 to the sides of the barrel mounting sections 28 of clamp plates 22. The clamp plates 22 are thereby rigidly mounted to the barrel 14 of the mortar 12. In the embodiment shown, the clamp plates 22 are mounted to barrel 14 at longitudinally-spaced locations with the surfaces of the plates generally or near parallel to one another and perpendicular to the longitudinal axis 16. The clamp plates 22 and clamps 24 can be formed from aluminum or steel alloy. Recesses can be included in the clamp plates 22 to enhance their strength and weight characteristics. As perhaps best shown in FIG. 6, the side of each clamp plate 22 facing the cradle 20 has four recesses 29 arranged in a rectangular pattern on the cradle supporting section 26. Each of the recesses 29 is located at the position at which an elastomer isolator 27 can be free to deflect when mounted to the clamp plate 22.

Cradle 20 functions as an interface between elastomer isolators 27 and navigation system 18 (FIG. 1), and can be described with reference to FIGS. 2–4 and 7–10. As shown, the cradle 20 includes a base such as base plate 40 and a pair of supports such as side plates 42 which are mounted to and extend in a perpendicular direction from the opposite ends of the base plate. Like the clamp plates 22, base plate 40 and side plates 42 of cradle 20 can be formed from aluminum alloy and include recesses. Fasteners such as screws 44 can be used to secure the side plates 42 to the base plate 40. The side plates 42 could also be welded to base plate 40, or cradle 20 could be formed from one solid piece of aluminum alloy.

Figure 11:
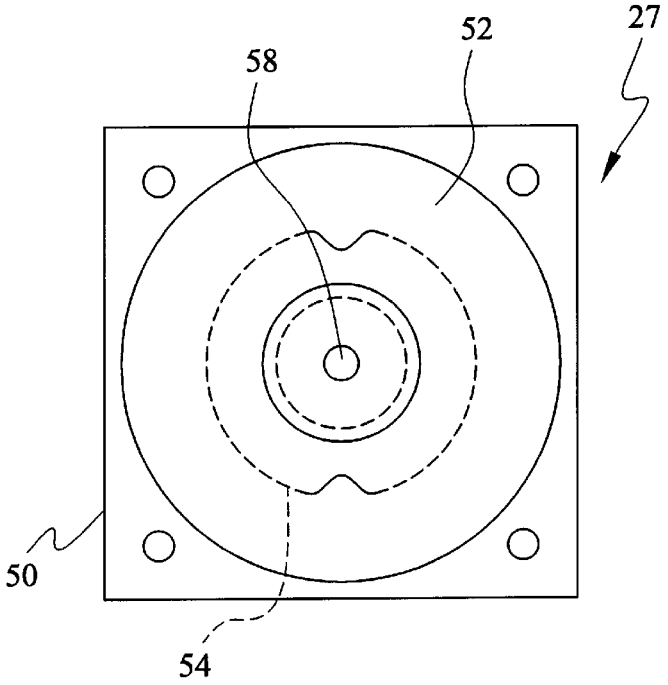
FIG. 11 is a plan view of an elastomer isolator of the isolation mount system shown in FIG. 1.
Figure 12:
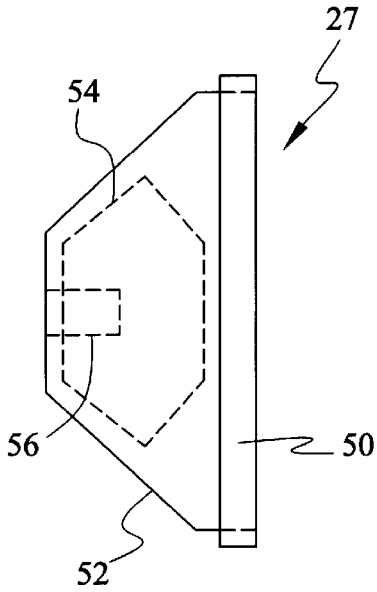
FIG. 12 is a side view of the elastomer isolator shown in FIG. 11.

Elastomer isolators 27 are illustrated in FIGS. 11 and 12. Each isolator 27 includes an aluminum alloy base plate 50 and a conical elastomer member 52. The base end of elastomer member 52 extends from an aperture through the base plate 50. Elastomer member 52 is molded or otherwise formed with a metal insert 54. Insert 54 has a threaded bore 56 which is oriented toward the tip or peak end of the elastomer member 52 and aligned with a hole 58 in the elastomer member. Those skilled in the art will recognize that the elastomer material from which the member 52 is formed, and the size, shape and other features of the member, can be selected to achieve the desired degree of shock and temperature isolation for a desired mounting application. In one embodiment, for example, elastomer member 52 has a base end diameter of about 2.3 inches, a peak end diameter of about 0.8 inches, and a height of about 1.0 inches. Elastomer members 52 can be formed from silicone or other suitable elastomeric materials. Isolators 27 of the type described herein are commercially available from Lord Mechanical Products of Erie, Pa. In the embodiment of the invention described herein, elastomer members 52 are formed from MEA blend silicone from Lord Mechanical Products.

Figure 2:
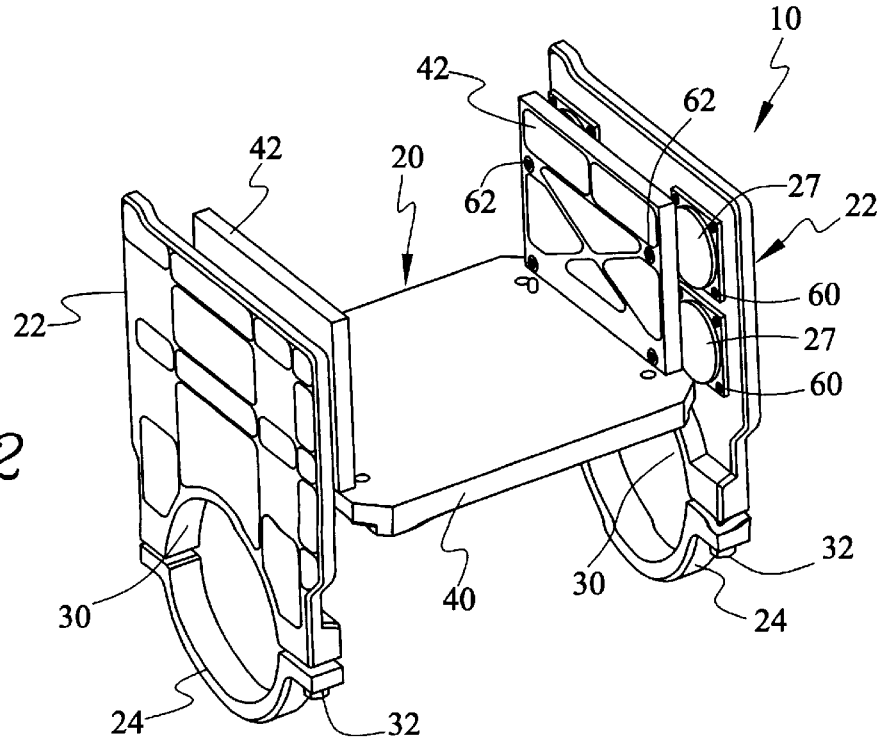
FIG. 2 is an isometric view of the isolation mount system shown in FIG. 1.
Figure 3:
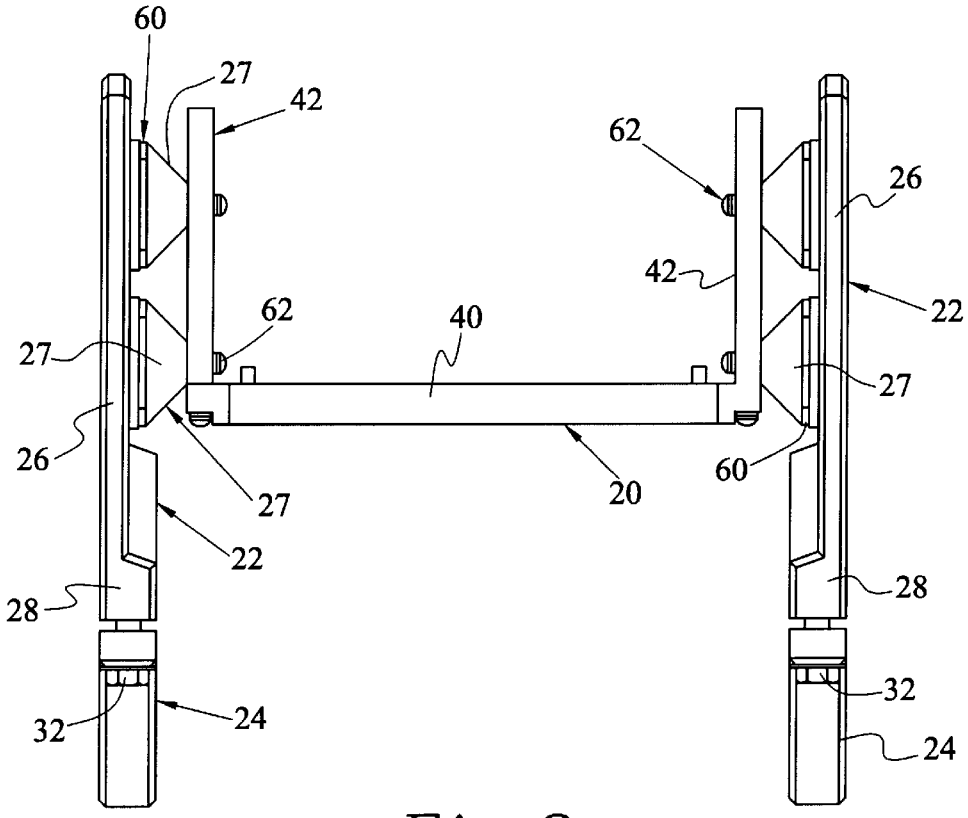
FIG. 3 is a side view of the isolation mount system shown in FIG. 1.
Figure 4:
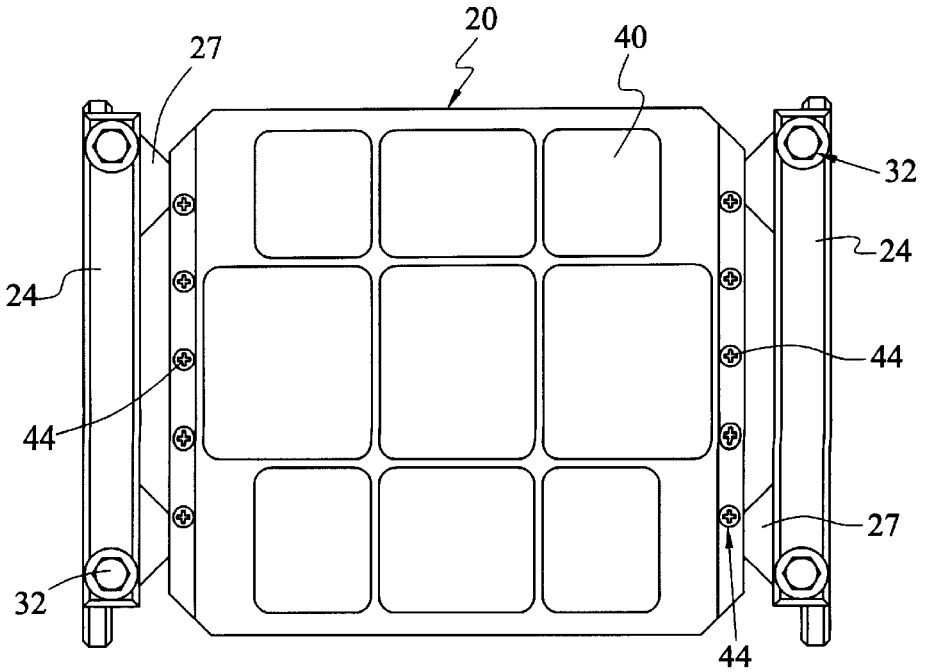
FIG. 4 is a bottom view of the isolation mount system shown in FIG. 1.
Figure 5:
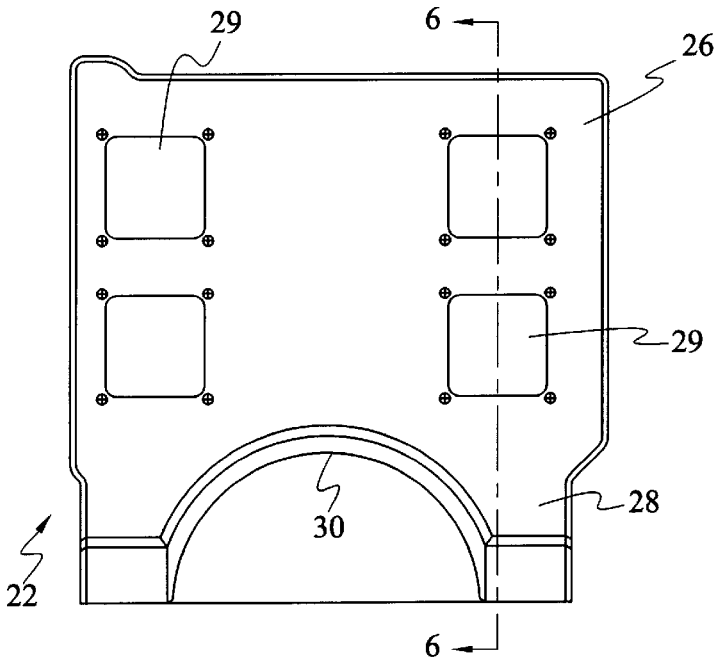
FIG. 5 is a plan view of a clamp plate of the isolation mount system shown in FIG. 1, showing the side of the plate facing the cradle.
Figure 6:
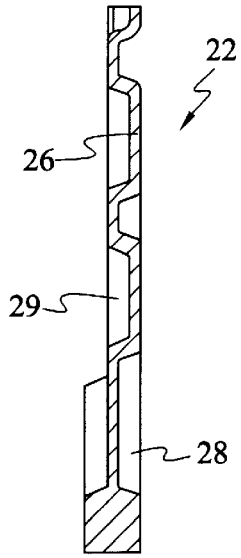
FIG. 6 is a sectional view of a clamp plate, taken along line 6—6 in FIG. 5.
Figure 10:
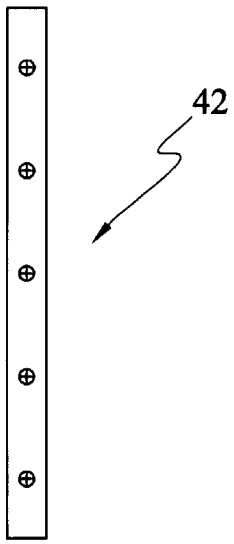
FIG. 10 is a bottom view of a side plate of the cradle.
Figure 9:
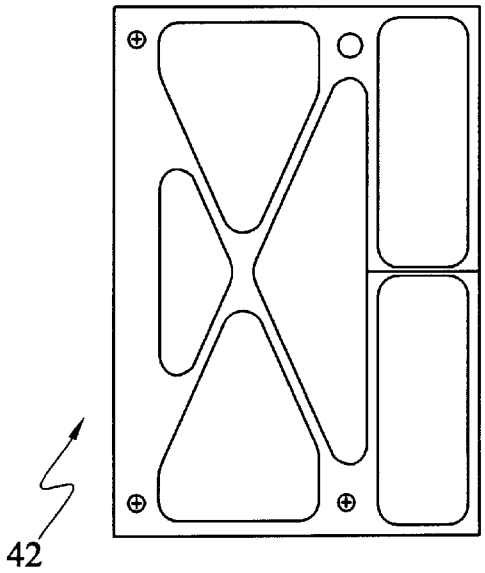
FIG. 9 is a plan view of a side plate of the cradle of the isolation mount system shown in FIG. 1, showing the side of the plate opposite the clamp plate.
Figure 8:
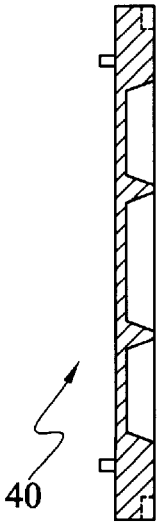
FIG. 8 is a sectional view of the base plate of the cradle, taken along line 8—8 in FIG. 7.
Figure 7:
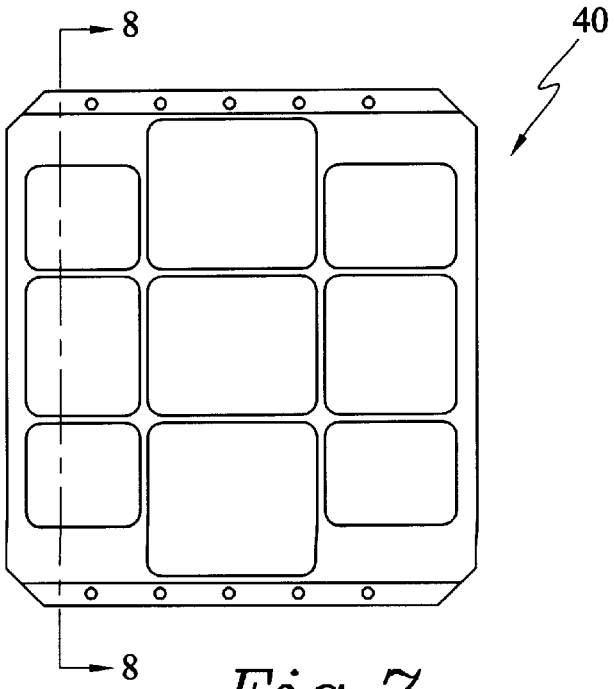
FIG. 7 is a bottom plan view of the base plate of the cradle of the isolation mount system shown in FIG. 1.

FIGS. 2–4 illustrate the elastomer isolators 27 mounted to support the cradle 20 from the artillery mount formed by clamp plates 26. Elastomer isolators 27 are preferably spaced and positioned to be symmetric with the center of gravity of the cradle 20 when the navigation system 18 (FIG. 1) is mounted thereto (i.e., center of gravity mounted). The embodiment of the isolation mount system 10 described herein includes four rectangularly arranged elastomer isolators 27 for mounting each cradle side plate 42 to the cradle mounting section 26 of the adjacent clamp plate 22. The base plates 50 of the isolators 27 are secured to the clamp plates 26 over the recesses 29 by fasteners such as screws 60. The peak ends of elastomer isolators 27 are secured to the side plates 42 of cradle 20 by screws 62 which extend through the side plates and into the bores 56 of the inserts 54 of the elastomer isolators.

Isolation mount system 10 provides a number of important advantages. In particular, it provides sufficient three-dimensional shock and thermal isolation to enable a navigation system mounted to the barrel of a non-recoiled artillery to maintain alignment accuracy on the barrel and to operate within its shock and temperature reliability and terminal failure limits, even in the harsh environment present during rapid firing sequences. By way of example, the embodiment of the isolation system mount described above can support a navigation system of up to approximately 21 pounds. The mount is also relatively light weight, weighing less than 26 pounds as shown and described. During a rapid firing sequence (e.g., two cycles, where each cycle includes 16 rounds in one minute, followed by 4 rounds in the next minute, followed by a 90 second wait) the barrel of a non-recoiled artillery can heat to temperatures up to 600° F. and be subjected to forces of up to 70 Gs at 20 Hz. Isolation system mounts described above mounted on artillery of this type have demonstrated the capability of isolating the navigation systems mounted thereto to junction temperatures less than about 220° F. and shock levels less than 20 Gs at 20 Hz. These temperature and shock values are generally within the qualified reliability range specification limits for sensitive electronic equipment such as artillery navigation systems. The relatively low natural frequency of the elastomer isolators also allows the mount to provide a high degree of filtering and isolation from higher frequency shocks (e.g., those above 20 Hz).

Although the present invention has been described with reference to preferred embodiments, those skilled in the art will recognize that changes can be made in form and detail without departing from the spirit and scope of the invention.

The embodiments of the invention in which an exclusive property or right is claimed are defined as follows:

1. An isolation system mount for mounting sensitive electronic equipment to artillery, comprising:

an artillery mount;

an electronic equipment cradle; and at least two elastomer isolators each having a first portion mechanically attached to the artillery mount and a second portion mechanically attached to the electronic equipment cradle, wherein the elastomer isolators elastomerically support the equipment cradle from the artillery mount to provide three-dimensional shock and/or thermal isolation, wherein the at least two elastomer isolators are attached to different sides of the electronic equipment cradle.

2. The isolation system mount of claim 1 wherein the at least two elastomer isolators are positioned to center-of-gravity mount the electronic equipment cradle to the artillery mount.

3. The isolation system mount of claim 2 further comprising a plurality of additional elastomer isolators arranged to attach the artillery mount to the electronic equipment cradle, wherein the at least two elastomer isolators and the additional elastomer isolators are symmetrically positioned about the center of gravity of the electronic equipment cradle when electronic equipment is mounted thereto.

4. The isolation system mount of claim 1 wherein the artillery mount includes one or more clamps for mounting the artillery mount to an artillery barrel.

5. The isolation system mount of claim 1 wherein:

the artillery mount includes first and second spaced supports;

the electronic equipment cradle includes:

a base; and first and second spaced supports extending from the base; and the at least two elastomer isolators include:

a first set of one or more elastomer isolators arranged to mount the first support of the artillery mount to the first support of the electronic equipment cradle; and a second set of one or more elastomer isolators arranged to mount the second support of the artillery mount to the second support of the electronic equipment cradle.

6. The isolation system mount of claim 5 wherein the first support of the artillery mount has a first set of one or more recesses, wherein the second support of the artillery mount has a second set of one or more recesses, wherein the first set of one or more elastomer isolators are attached to the first support of the artillery mount over the first set of one or more recesses, and wherein the second set of one or more elastomer isolators are attached to the second support of the artillery mount over the second set of one or more recesses.

7. The isolation system mount of claim 6 wherein each of the elastomer isolators of the first and second sets of one or more elastomer isolators is conically shaped having a base and a tip, wherein the base of each of the elastomer isolators of the first and second sets of one or more elastomer isolators is the first portion, wherein the tip of each of the elastomer isolators of the first and second sets of one or more elastomer isolators is the second portion, and wherein the tip of each of the elastomer isolators of the first and second sets of one or more elastomer isolators is attached to a corresponding one of the first and second supports of the electronic equipment cradle.

8. The isolation system mount of claim 7 wherein each of the elastomer isolators of the first and second sets of one or more elastomer isolators includes a metal insert between a corresponding base and a corresponding tip.

9. The isolation system mount of claim 1 wherein the artillery mount has a recess, and wherein the first portion of the elastomer isolator is attached to the artillery mount over the recess.

10. The isolation system mount of claim 9 wherein the elastomer isolator is conically shaped having a base and a tip, wherein the base is the first portion, wherein the tip is the second portion, and wherein the tip is attached to the electronic equipment cradle.

11. The isolation system mount of claim 10 wherein the elastomer isolator includes a metal insert between the base and the tip.

12. An isolation system mount for mounting shock and/or temperature sensitive electronic equipment to non-recoiled artillery, comprising:

an artillery barrel mount including first and second spaced-apart plates, the mount being formed so as to receive an artillery barrel with the first and second plates being spaced along an axis which is parallel to a longitudinal axis of the artillery barrel when the mount is mounted to the artillery barrel;

an electronic equipment cradle including first and second spaced-apart plates, the cradle being attachable to the barrel mount with the first and second plates of the electronic equipment cradle being spaced along an axis which is parallel to the axis of the artillery barrel when the mount and the cradle are mounted to the artillery barrel;

first and second sets of elastomer isolators, each isolator of the first set having a first end attached to the first plate of the artillery barrel mount and a second end attached to the first plate of the electronic equipment cradle, and each isolator of the second set having a first end attached to the second plate of the artillery barrel mount and a second end attached to the second plate of the electronic equipment cradle, wherein the first and second sets of elastomer isolators elastomerically support the equipment cradle from the artillery barrel mount to provide three-dimensional shock and/or thermal isolation.

13. The isolation system mount of claim 12 wherein the elastomer isolators are positioned to center-of-gravity mount the electronic equipment cradle to the artillery barrel mount.

14. The isolation system mount of claim 13 wherein the artillery mount includes clamps for mounting the first and second plates to the artillery barrel.

15. The isolation system mount of claim 14 wherein the electronic equipment cradle further includes a base extending between the first and second plates of the cradle.

16. The isolation system mount of claim 15 wherein the elastomer isolators are conically shaped and have base ends and tip ends, and wherein the base ends of the isolators are mounted to the artillery barrel mount and the tip ends are mounted to the electronic equipment cradle.

17. The isolation system mount of claim 12 wherein the elastomer isolators are conically shaped and have base ends and tip ends, and wherein the base ends of the isolators are mounted to the artillery barrel mount and the tip ends are mounted to the electronic equipment cradle.

18. The isolation system mount of claim 12 wherein the first plate of the artillery mount has a first set of recesses, wherein the second plate of the artillery mount has a second set of recesses, wherein the first set of elastomer isolators are attached to the first plate of the artillery mount over the first set of recesses, and wherein the second set of elastomer isolators are attached to the second plate of the artillery mount over the second set of recesses.

19. The isolation system mount of claim 18 wherein each of the elastomer isolators of the first and second sets of elastomer isolators is conically shaped having a base and a tip, wherein the base of each of the elastomer isolators of the first and second sets of elastomer isolators is the first portion, wherein the tip of each of the elastomer isolators of the first and second sets of elastomer isolators is the second portion, and wherein the tip of each of the elastomer isolators of the first and second sets of elastomer isolators is attached to a corresponding one of the first and second plates of the electronic equipment cradle.

20. The isolation system mount of claim 19 wherein each of the elastomer isolators of the first and second sets of elastomer isolators includes a metal insert between a corresponding base and a corresponding tip.

21. An isolation system comprising:

first and second mount plates being formed so as to receive an artillery barrel;

an electronic equipment cradle including first and second cradle plates and an electronic equipment receiving base, the electronic equipment receiving base being secured at opposite ends to the first and second cradle plates;

a first set of elastomer isolators, each elastomer isolator of the first set having a first end attached to the first mount plate and a second end attached to the first cradle plate; and, a second set of elastomer isolators, each elastomer isolator of the second set having a first end attached to the second mount plate and a second end attached to the second cradle plate.

22. The isolation system of claim 21 wherein the elastomer isolators are positioned to center-of-gravity mount the electronic equipment cradle to the first and second mount plates.

23. The isolation system of claim 22 wherein the first and second mount plates include clamps that are provided to clamp the first and second mount plates to the artillery barrel.

24. The isolation system of claim 22 wherein each of the elastomer isolators of the first and second sets of elastomer isolators is conically shaped and has a base end and a tip end, wherein the bases of the elastomer isolators of the first set of elastomer isolators are attached to the first mount plate, wherein the tips of the elastomer isolators of the first set of elastomer isolators are attached to the first cradle plate, wherein the bases of the elastomer isolators of the second set of elastomer isolators are attached to the second mount plate, and wherein the tips of the elastomer isolators of the second set of elastomer isolators are attached to the second cradle plate.

25. The isolation system of claim 21 wherein each of the elastomer isolators of the first and second sets of elastomer isolators is conically shaped and has a base end and a tip end, wherein the bases of the elastomer isolators of the first set of elastomer isolators are attached to the first mount plate, wherein the tips of the elastomer isolators of the first set of elastomer isolators are attached to the first cradle plate, wherein the bases of the elastomer isolators of the second set of elastomer isolators are attached to the second mount plate, and wherein the tips of the elastomer isolators of the second set of elastomer isolators are attached to the second cradle plate.

26. The isolation system of claim 21 wherein the first mount plate has a first set of recesses, wherein the second mount plate has a second set of recesses, wherein the first set of elastomer isolators are attached to the first mount plate over the first set of recesses, and wherein the second set of elastomer isolators are attached to the second mount plate over the second set of recesses.

27. The isolation system of claim 26 wherein each of the elastomer isolators of the first and second sets of elastomer isolators is conically shaped having a base and a tip, wherein the base of each of the elastomer isolators of the first and second sets of elastomer isolators is the first end, wherein the tip of each of the elastomer isolators of the first and second sets of elastomer isolators is the second end.

28. The isolation system of claim 27 wherein each of the elastomer isolators of the first and second sets of elastomer isolators includes a metal insert between a corresponding base and a corresponding tip.

29. The isolation system of claim 21 wherein the elastomer isolators of the first set of elastomer isolators are between the first mount plate and the first cradle plate, and wherein the elastomer isolators of the second set of elastomer isolators are between the second mount plate and the second cradle plate.

* * * * *